US009718648B2

(12) United States Patent
Sipilä et al.

(10) Patent No.: US 9,718,648 B2
(45) Date of Patent: Aug. 1, 2017

(54) MOVING WALK

(71) Applicant: KONE Corporation, Helsinki (FI)

(72) Inventors: Tomi Petteri Sipilä, Helsinki (FI); Andreas Mnich, Essen (DE); Ralf Weber, Duisburg (DE); Arttu Hult, Helsinki (FI); Hongbin Gary Yao, Kunshan (CN)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 15/166,000

(22) Filed: May 26, 2016

(65) Prior Publication Data

US 2016/0264380 A1 Sep. 15, 2016

Related U.S. Application Data

(63) Continuation of application No. PCT/CN2014/070175, filed on Jan. 6, 2014.

(51) Int. Cl.
*B66B 21/02* (2006.01)
*B66B 23/22* (2006.01)
(Continued)

(52) U.S. Cl.
CPC ..... *B66B 23/22* (2013.01); *B66B 21/10* (2013.01); *B66B 23/00* (2013.01); *B66B 23/14* (2013.01); *B66B 23/24* (2013.01)

(58) Field of Classification Search
CPC ..... B65G 21/02; B65G 21/06; B66B 23/00; B66B 11/0226; B66B 11/0253
(Continued)

(56) References Cited

U.S. PATENT DOCUMENTS 4,064,986 A * 12/1977 Bertovich ..... B66B 23/145 198/326
6,471,034 B2 * 10/2002 Lunardi ..... B66B 23/14 198/321
(Continued)

FOREIGN PATENT DOCUMENTS

CN 101804939 A 8/2010
CN 102485628 A 6/2012
(Continued)

*Primary Examiner* — James R Bidwell
(74) *Attorney, Agent, or Firm* — Birch, Stewart, Kolasch & Birch, LLP

(57) ABSTRACT

The invention relates to a moving walk having an endless conveyor member comprising pallets and at least one longitudinal drive member to which the pallets are connected, which drive member is engaged by a drive unit, whereby the endless conveyor member runs in a middle section of the moving walk along an upper conveying track and along a lower return track; at both ends of the middle section a respective end section is located, whereby each end section comprises an entrance/exit area of the moving walk and a transfer means for transferring the endless conveyer member from the conveyor track to the return track and vice versa. The middle section comprises a self-supporting support structure, wherein the support structure is formed by roller rails, by cross beams and by support brackets, whereby the roller rails have an upper rail surface for rollers of the pallets, the cross beams connect the roller rails and/or the support brackets on both sides of the moving walk and the support brackets comprise the footing of the support structure and are spaced apart in the longitudinal direction of the roller rails and wherein the roller rails and/or the cross beams are mounted to the support brackets. This space saving support structure is easy to deliver to the building site and easy to install.

16 Claims, 5 Drawing Sheets

Figure 1:
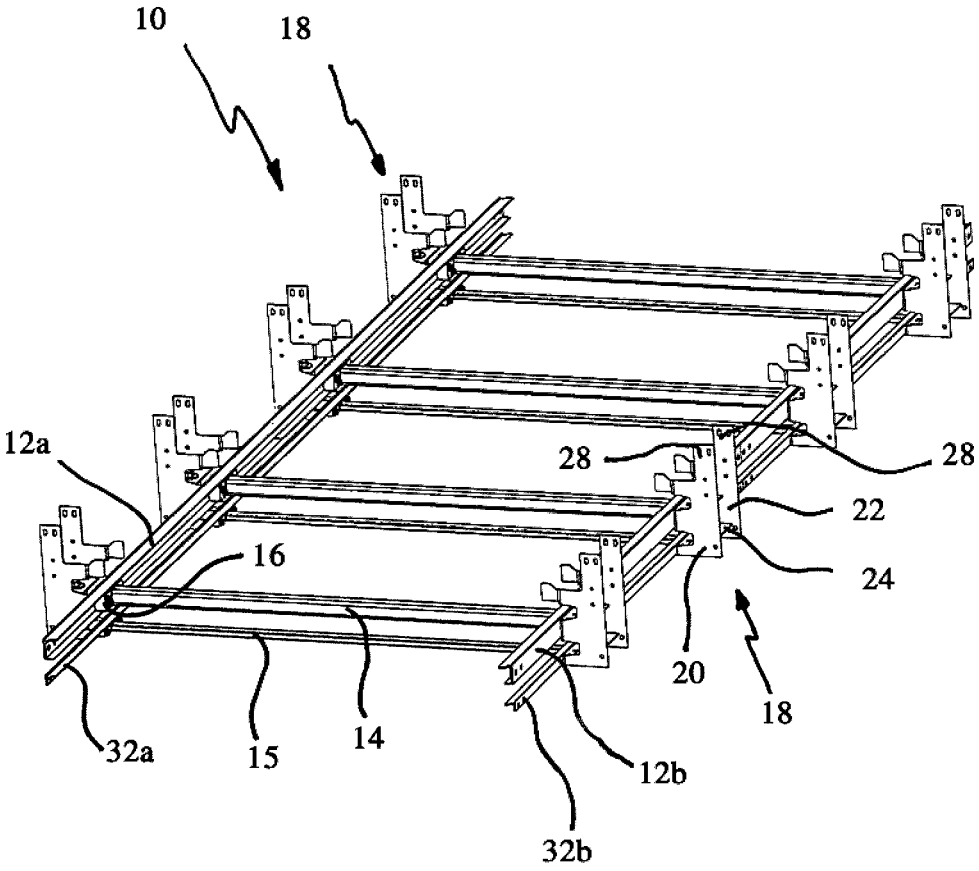

(51) Int. Cl.

| | |
|---|---|
| ***B66B 21/10*** | (2006.01) |
| ***B66B 23/14*** | (2006.01) |
| ***B66B 23/00*** | (2006.01) |
| ***B66B 23/24*** | (2006.01) |

(58) Field of Classification Search
USPC ..... 198/321, 326, 860.1
See application file for complete search history.

(56) References Cited

U.S. PATENT DOCUMENTS

| | | | | |
|---|---|---|---|---|
| 2005/0211534 | A1 | 9/2005 | Tefend | |
| 2007/0029161 | A1* | 2/2007 | Streibig | B66B 23/14 198/326 |
| 2009/0101470 | A1 | 4/2009 | Gonzalez Alemany et al. | |
| 2015/0239711 | A1* | 8/2015 | Makovec | B66B 23/00 198/326 |
| 2015/0274490 | A1* | 10/2015 | Vlad | B66B 23/14 198/323 |
| 2016/0137460 | A1* | 5/2016 | Makovec | B66B 23/14 198/326 |

FOREIGN PATENT DOCUMENTS

| | | | |
|---|---|---|---|
| CN | 203295011 | U | 11/2013 |
| JP | 2008-24480 | A | 2/2008 |
| JP | 2011-63388 | A | 3/2011 |
| WO | WO 97/44272 | A1 | 11/1997 |
| WO | WO 2014/048809 | A1 | 4/2014 |

* cited by examiner

MOVING WALK

CROSS REFERENCE TO RELATED APPLICATIONS

This application is a Continuation of PCT International Application No. PCT/CN2014/070175, filed on Jan. 6, 2014, which is hereby expressly incorporated by reference into the present application.

The present invention refers to moving walks which are used in public places for passenger transport. These moving walks have an endless conveyor member comprising pallets and further comprising at least one longitudinal drive member to which the pallets are connected. The drive member which is usually a drive chain is engaged by a drive unit. Usually, two drive members are provided at both sides of the pallets. The endless conveyor member runs in the middle section of the moving walk along an upper conveying track and along a lower return track. At both ends of the middle section, a respective end section is located whereby each end section comprises an entrance or exit area of the moving walk. If the moving walk is running in both directions, each end section builds the entrance as well as the exit area of the moving walk, corresponding to the actual running direction of the moving walk. Furthermore, each end section comprises transfer means for transferring the endless conveyer member from the conveyor track to the return track and vice versa. The middle section together with the both end sections which are placed at both ends of the middle section form essentially the complete moving walk structure. At least the middle section of the moving walk comprises a self-supporting support structure. Such a moving walk according to the base principle of the present invention is known for example from the US 2009/0101470 A1. In this arrangement, longitudinal profiles are provided on both sides of the pallets which are forming the frame of the support structure comprising the roller rails for the conveyor track and the return track and further comprising adjustable feet for supporting the support structure of the floor. These longitudinal profiles are connected via cross beams which are extending horizontally between both sides of the conveyor member perpendicular to the longitudinal or running direction of the moving walk.

A support structure of this kind is quite complicated to manufacture and therefore expensive. Furthermore, the structure is comparably voluminous so that it increases the total space requirement of the moving walk.

It is therefore object of the present invention to create a moving walk having a lower space requirement and which is less expensive than known moving walk structures.

The object of the invention is solved with a moving walk according to claim 1. Preferred embodiments of the invention are subject-matter of the dependent claims.

According to the invention, the support structure at least of the middle section of the moving walk is formed by separate roller rails, cross beams and support brackets which are spaced apart in the longitudinal direction of the roller rails. Therefore, according to the invention the support structure is formed by separate elements whereas in the prior art solution the support structure is formed from one profile which has the support function, footing as well as the function of the roller rails. The spaced apart support brackets of the present invention comprise the footing of the support structure and the roller rails or the cross beams are mounted to the support brackets. Whereas a solution is preferred wherein the roller rails are directly mounted to the support brackets, it is also possible that the cross beams are mounted to the support brackets and the roller rails are mounted to the cross beams so that this solution provides a kind of indirect mounting of the roller rails to the support brackets.

Compared with the prior art solution, the present invention has the advantage that in longitudinal direction of the moving walk, only the comparably small roller rails which are usually rectangular profiles or C-profiles configured only to carry the rollers of the pallets of the moving walk form the support structure parts extending in the longitudinal direction. These roller rails form much smaller profiles than the complicated integrated profile structure of the prior art. The mutual arrangement of the roller rails is kept by the support brackets which are spaced apart in longitudinal direction of the roller rails (and of the moving walk), usually in distances between 50 cm and 5 m, preferably between 2 m and 4 m. The support brackets are usually vertical profiles, preferably made of sheet metal, which profiles have an adjustable foot and a mounting area for the roller rails, i.e. for upper roller rails of the conveyor track and for lower roller rails of the return track. The upper roller rails are usually more rigid and/or larger than the lower roller rails as the upper roller rails have to carry the load of the passengers using the moving walk whereas the lower roller rails of the return track only carry the empty pallets. Eventually the support brackets have a mounting area for the cross beams, upper fixings for the balustrade and also fastening points for outer and inner cover plates to cover the support structure. Accordingly, a moving walk with the inventive support structure may be used in a moving walk located in a pit so that the pallets of the conveyor track are on the same level as the surrounding floor or it may be used for moving walks which are placed on an existing floor in a building so that the pallets of the conveyor track are on a higher level than the surrounding floor. In this case, the end sections also comprise ramps for getting from the floor level to the level of the pallets of the conveyor track and vice versa.

The roller rails which are supported by the spaced apart support brackets and which are connected by cross beams form a very lightweight and compact but rigid support structure which is solid enough to withstand the load and impact of a moving walk in everyday use.

Preferably, the cross beams are mounted horizontally and perpendicular to the longitudinal direction of the moving walk. Anyway, the cross beams may also be mounted in a different geometry, e.g. as a zigzag structure between the roller rails on both sides of the moving walk. The deviation of the cross beams from the perpendicular direction with respect to the longitudinal direction of the roller rails or moving walk may thus be between 0° and 45°, preferably between 0° and 25°.

The cross beams are preferably mounted only between the upper roller rails as these carry the load of the moving walk. But the cross beams may also extend between the upper roller rails as well as between the lower roller rails. In this case even two types of cross beams may be used whereby upper cross beams which are mounted between the upper roller rails should be more rigid than lower cross beams, which are mounted between the lower roller rails. Instead of upper and lower cross beams, also a cross beam structure may be used which comprise upper and lower cross beams and connects the two upper roller rails as well as the two lower roller rails. The cross beams may be formed of beams, shaped profiles or of grid structures according individual needs.

Preferably, the roller rails are directly mounted to the support brackets and the cross beams are mounted to the roller rails. This solution has the advantage that the roller rails, particularly the roller rails of the conveyor track which carry the main load of the moving walk transfer the impacted load directly to the support brackets which direct the load via their adjustable foot directly to the ground. By the fact that the cross beams are not mounted to the support brackets either but are mounted to the roller rails, the support brackets need less mounting area so that the complete arrangement can be made more space-saving while simultaneously a high level of rigidity of the support structure is maintained.

In a preferred embodiment of the invention, each support bracket consists of a bent U-shape sheet metal profile extending vertically. The middle section of the U-profile forms or comprises the mounting areas for the roller rails and the both side sections of the U-profile form two sections extending perpendicular to the longitudinal direction of the moving walk for fastening the balustrade and cover plates and eventually other elements. Connected to the interior of the U-profile, e.g. by screwing or welding, is a beam member comprising an adjustable foot. With this solution, the support bracket is a construction member which is easy to manufacture and has a high rigidity as to transfer all load from the moving walk to the floor on which the moving walk is supported. The U-profile may also be constructed from two rectangular angle profile members instead of one U-profile member.

Also the logistics for transferring the necessary construction parts of the moving walk to the construction site can be essentially reduced as the parts which are forming the support structure of the moving walk are only the roller rails having a comparably small profile cross-section, the comparably lightweight cross beams as well as the compact support brackets.

Although several bolts or corresponding mounting elements may be used to connect the roller rails and cross beams to the support brackets, preferably one cross beam and the corresponding roller rail are mounted to the support brackets with one common mounting bolt. This solution has the advantage that the mounting area for connecting all the three essential parts of the support structure, i.e. the cross beams, the roller rails and the support brackets, is essentially reduced.

At each support bracket, at least one mounting bolt is necessary to connect one of the two roller rails of the conveyor track, the corresponding cross beams (if a cross beam is used to connect the upper roller rails on both sides of the moving walk and the lower roller rails, respectively) and the support bracket. In this solution, preferably the cross beam(s) is(are) connected to the roller rail and the roller rail is connected to the support bracket so that the mounting bolt protrudes through the mounting face of the cross beam, through the profile of the roller rail into the mounting area of the support bracket.

In a preferred embodiment of the invention, the roller rail is a steel profile. It may be a closed profile as e.g. a rectangular profile, or an open profile as e.g. a C-profile or an angle profile (L-profile, T-profile or H-profile).

Preferably the roller rail has a width of at least 150% of the width of the rollers of the pallets. Furthermore, the vertical extension of the rectangular steel profile of the upper roller rail of the conveyor track can be kept below 200% of the width of the roller rail. The lower roller rail may have a very small cross-section, e.g. 100% of the roller width and a vertical extension of less than 100% of the roller width. Therefore, any of the roller rails has a steel profile which is essentially smaller than the profile of the support structure as known from US 2009/0101470 A1.

Preferably, the roller rail comprises a steel bushing for a mounting bolt so that when the roller rail is mounted to the support bracket via the mounting bolt, the support surface for the pallet rollers is not deformed.

In this connection, it has to be mentioned that regularly on each side of the moving walk, two roller rails have to be mounted in longitudinal direction of the moving walk, i.e. the upper roller rail for the conveyor track and the lower roller rail for the return track. Hereby, the steel profiles of both, the upper and lower roller rails, may be identical but it is also possible to use a larger steel profile for the upper roller rails for the conveyor track as the load impacted to the moving walk is brought to the conveyor track and not to the return track. As in the return track only the weight of the pallets has be carried, the lower roller rail for the return track can be made essentially smaller than the upper roller rail for the conveyor track, i.e. the cross-sectional area of the profile of the lower roller rails is preferably smaller than that of the upper roller rails. Via this measure, the construction is space saving while simultaneously rigid enough to carry the required loads of the moving walk.

In a preferred embodiment of the invention, the cross beams are mounted to the roller rails via enlarged end plates. Via this solution, the connection between the cross beams and the roller rails is sufficiently rigid.

In a preferred embodiment of the invention, the support brackets have fixings for a balustrade fastening element. This solution has the advantage that the balustrade is not directly fixed to the support brackets but via a balustrade fastening element which is configured particularly to the clamping and holding function of the balustrade.

Accordingly, different balustrade fastening elements for different kinds of balustrades, e.g. metal balustrades, glass balustrades, etc. can be connected to the fixings of the support brackets. Accordingly, with one type of support brackets, different types of balustrades can be mounted via adapted balustrade fastening element. The balustrade fastening element is regularly a certain type of clamping arrangement which allows the balustrade element connected to the top of the support structure to extend vertically from the support structure in upper direction. In an alternative embodiment the balustrade could directly be mounted to the back of the support bracket facing away from the moving walk perpendicular to its longitudinal direction.

Preferably, each support bracket consists of a vertically extending U-profile comprising one middle section with the mounting areas of the roller rails and two side sections on both sides thereof, to which U-profile a beam member, preferably mounted within the three sections, comprising an adjustable foot is connected. The advantage of this solution is that the middle section of the U-profile is on both sides reinforced by the two side sections so that the middle section is rigid enough to carry the loads form the roller rails. The connection of the beam member carrying the adjustable foot to the surrounding three sections of the U-profile is advantageous with respect to the force progression from the roller rails to the support base of the moving walk, e.g. the pit or the floor of a building. The beam member may be connected to the U-profile via any desired connecting technique, e.g. via a form fitting lock, via bolts or via welding.

Preferably, the support brackets have a recess for a handrail belt of the moving walk. The support structure is therefore adapted to guide the handrail belt on its return path back from the end of the balustrade to the beginning of the balustrade where it gets to the top of the balustrade to be gripped by passengers using the moving walk. The recess in the support bracket is preferably a horizontally extending recess which is open to the inner side of the support bracket facing the pallet.

In the above mentioned solution where the support brackets is formed by a U-profile having two side sections, the side sections preferably comprise the fixings for the balustrade fastening element as well as the recess for the handrail belt. Via this solution, additional support and guiding function for the balustrades and for the handrail belt is taken over by the two side sections of the support bracket. Hereby, the recess for the handrail belt is preferably located below the fixings for the balustrade.

As it has been mentioned above, the inventive support structure of the moving walk preferably comprises upper roller rails for the conveyor track and lower roller rails for the return track whereby the support brackets have two vertically spaced apart mounting areas for the upper and lower rails. Via this solution, the loaded pallets on the conveyor track as well the pallets on the return track can be securely guided via the upper and lower roller rails which are rigidly supported by the support brackets. In case the support bracket is preferably formed by a U-profile carrying a beam member, the mounting areas for the upper and lower roller rails are preferably located at the middle section of the U-profile or at the beam member.

Preferably, the support brackets, particularly the side sections of the U-profile, comprise fastening points for outer and inner cover plates of the support structure. Via this measure, the support structure may be covered to be located on floor of a building so that the cover is adapted to face the public. By the cover plates, the technical components of the support structure as well as the pallets, pallet rollers and drive members are protected against un-allowed access and it is possible to provide the support structure via the cover plates with individual designs according to the requirements of special buildings. Preferably the cover plates are made of sheet metal.

Preferably the roller rails or roller tracks (these formulations can be used as equivalent) have a step in each profile end. With this design the rails can be adjusted in length. This reduces the required manufacture accuracy of the roller rails.

The roller rails for guiding the pallets can also be realised in different ways:

As a separate guiding nose fixed to a profile,

As a profile having a steel bar welded longitudinal nose,

The roller rail can be roll formed, e.g. like current solutions in conventional units.

Preferably the adjustable foot has a spherical joint to align the support structure with an uneven floor. This design reduces stresses that would otherwise be imposed on the foot.

In an alternative embodiment the support bracket may also comprise more sections than three. Further, also the beam member may be used to connect the side sections. In this case the support bracket may consist of two separate metal sheets connected by the beam member comprising the mounting areas for the roller rails and the adjustable foot. This embodiment is very rigid as all essential loads are carried by the massive beam member.

The above-mentioned different embodiments of the invention may be combined with each other arbitrarily as long as this is technically feasible.

Figure 2:
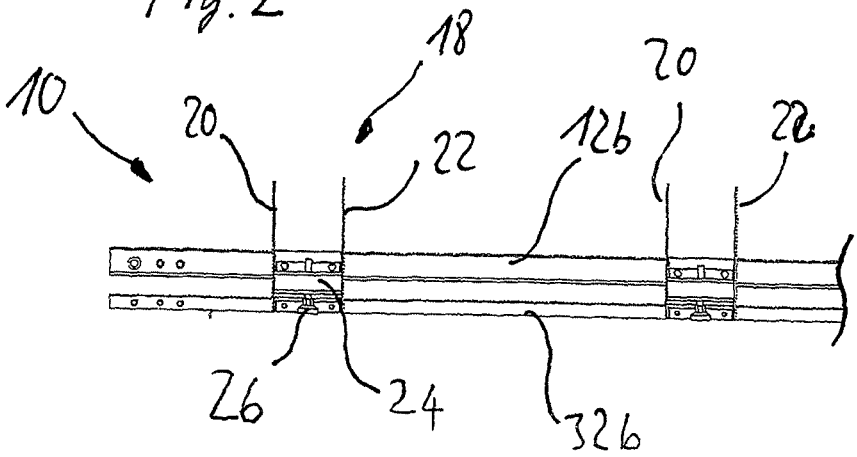
Figure 3:
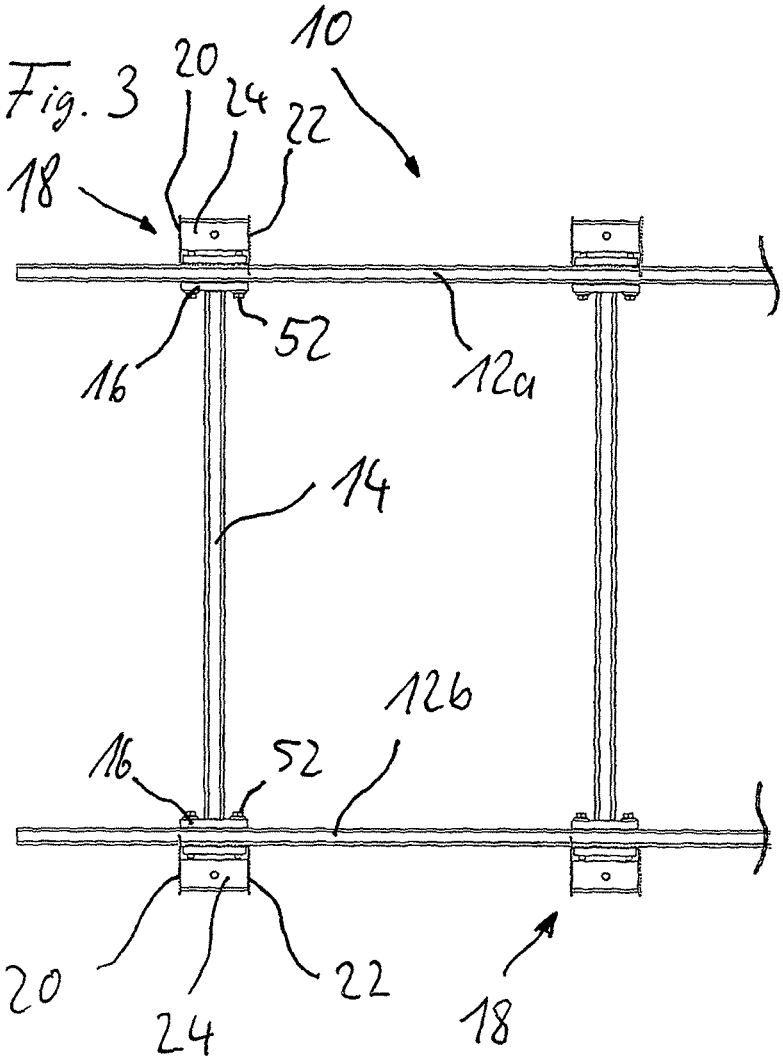
Figure 4:
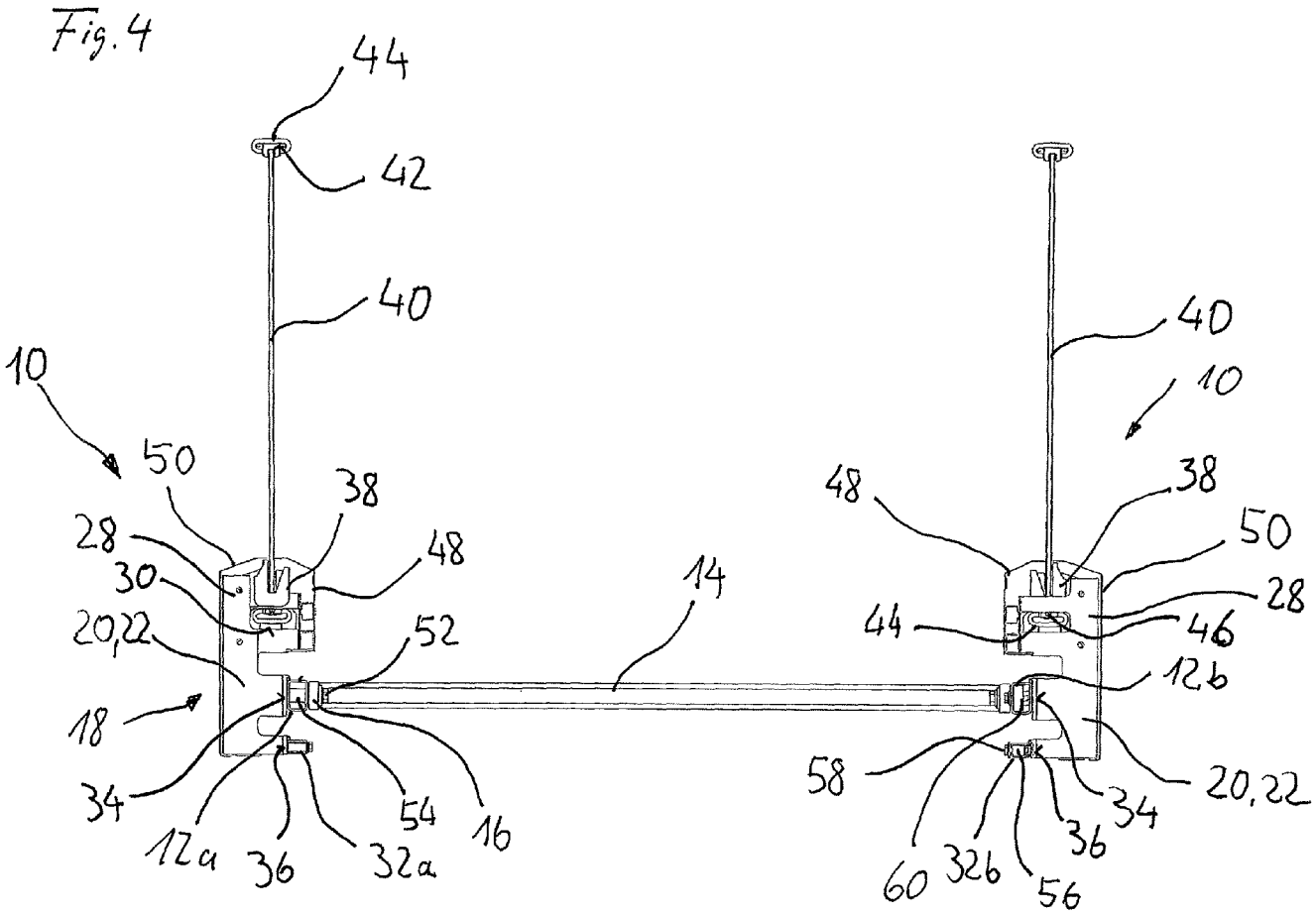
Figure 5:
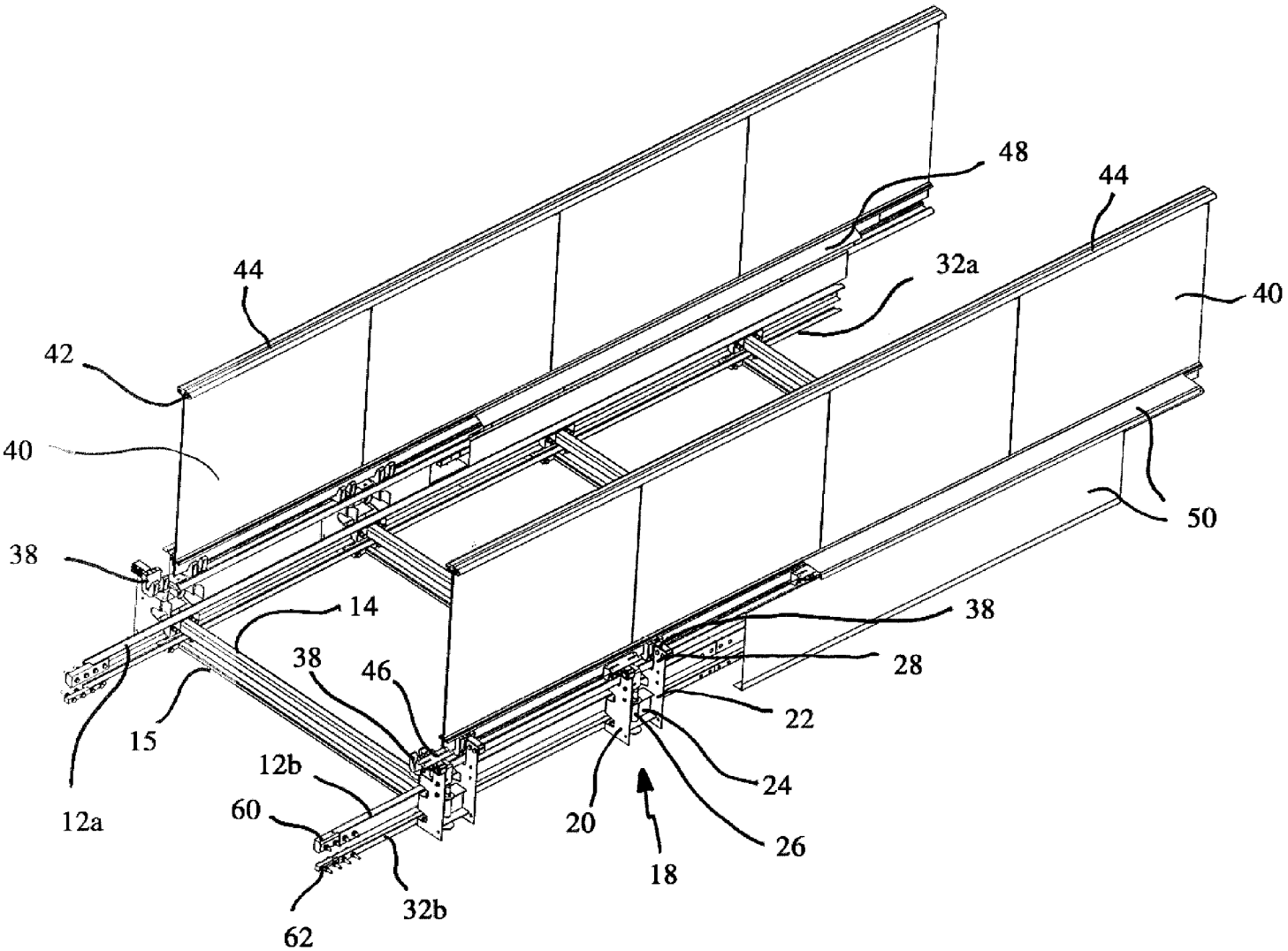

The invention is now described via preferred embodiments in connection with the attached drawings. In these drawings:

FIG. 1 shows a perspective view of a support structure of a moving walk comprising upper and lower roller rails, cross beams and support brackets, FIG. 2 shows a side view of the support structure of FIG. 1, FIG. 3 shows a top view of the support structure of FIG. 1, FIG. 4 shows a front view of a moving walk having the support structure of FIG. 1 comprising balustrades and a handrail, FIG. 5 shows a perspective view of the moving walk of FIG. 4, and FIGS. 6*a* to 6*c* show three detailed views of the support bracket.

FIG. 1 shows the support structure 10 of the inventive moving walk, which support structure comprises upper roller rails 12*a,b* extending in longitudinal direction of the moving walk on both sides thereof The upper roller rails 12*a,b* are configured to carry the loaded pallets on the conveyor track of the moving walk and are connected via cross beams 14 which are mounted via their end plates 16 directly to the upper roller rails 12*a*, 12*b*. The upper rails 12*a*, 12*b* are mounted to support brackets 18 which comprise a vertical extending U-shaped profile having a middle section 21 and two side sections 20, 22 extending perpendicular to the longitudinal axis of the moving walk. In the interior between the three sections 20, 21, 22 a beam member 24 is connected, e.g. by bolts, by a form-fit lock or by welding (see FIGS. 2 and 6*a* to 6*c*). The beam member 24 carries an adjustable foot 26. The two side sections 20, 22 of the support bracket 18 comprise in their upper section fixings 28 for a balustrade fastening element as well as a horizontally extending recess 30 for passing a handrail belt there through (See FIG. 4).

Furthermore, the support structure 10 comprises two lower roller rails 32*a,b* for guiding the unloaded pallet rollers on the return track. For this reason the cross-sectional area of the profile of the lower roller rails 32*a,b* is smaller than that of the upper roller rails 12*a,b*. As it may be seen in FIG. 4, the upper roller rails 12*a*, 12*b* are mounted to an upper mounting area 34 provided at (connected to) the two side sections 20, 22 whereas the lower roller rails 32*a,b* are mounted to a lower mounting area 36 also provided at (connected to) the both side sections 20, 22 of the support bracket 18. Accordingly, the support structure as shown in FIGS. 1 to 3 discloses a compact easy mountable support structure comprising all necessary components for building up a moving walk. The support structure requires a minimum of components so that the logistic relating storing as well as delivering the parts to a construction site is reduced essentially.

Although the new support structure of the inventive moving walk is very lightweight and space-saving, it is rigid enough to carry all load imposed to conventional moving walks which are generally located in public places as malls, airports or railway stations. The support structure is fitted to be used in on-floor constructions wherein moving walks are mounted after the building floor has been completed or for mounting in a pit so that the pallets of the conveyor track of the moving walk are essentially on the same level as the floor of the building.

FIGS. 4 and 5 show the middle section of the inventive moving walk with the support structure being covered by cover plates and carrying a balustrade as well as a handrail belt.

The fixings 28 of the side sections 20, 22 of the support brackets 18 carry a balustrade fastening element 38 in form of a clamp in which a glass balustrade 40 can be mounted and fitted in place as to extend vertically from the top of the support structure 10. The top of the glass balustrade elements comprises a handrail guide 42. Also the side sections 20, 22 of the support brackets 18 comprise a handrail guide 46. The handrail guides 42 carry a handrail belt 44 which is thus running together with the pallets of an endless conveyor member of the moving walk. In the support structure 10, the handrail belt 44 runs guided by the same handrail guides 46 in the recesses 30 of the side sections 20, 22. The support structure 10 consisting of the support brackets 18, the upper and lower roller rails 12*a,b*, 32*a,b* and the cross beams 14 further comprises inner cover plates 48 which are mounted to the side sections 20, 22 of the support brackets 18 on the side facing the endless conveying member and outer cover plates 50 mounted to said side sections 20, 22 on the outside of the support structure 10. The cross beams 14 are mounted via their end plates 16 directly to the upper roller rails 12*a,b* with the same bolts 52 with which the upper roller rails 12*a,b* are mounted to the upper mounting area 34 of the support brackets 18. On this behalf, the upper roller rails 12*a,b* comprise metal bushings so that the upper roller rails 12*a,b* are not deformed when the cross beams 14 and upper roller rails 12*a,b* are screwed to the mounting area 34 of the support bracket 18 whereby a horizontal force is imposed on the upper roller rails 12*a,b*.

Also the lower roller rails 32*a,b* comprise bushings 56 in their interior to prevent deformation when fixed to the lower mounting area 36 of the support bracket 18 via lower mounting bolts 58. As it can be seen in FIG. 5, the upper and lower roller rails 12*a,b* and 32*a,b* are provided as elements with a certain length of 2-5 m. These elements are connected with connecting pieces 60, 62 which are inserted in the open ends of the upper and lower roller rail elements whereafter these connecting pieces are fixed via bolts to the ends of the upper and lower roller rail elements.

The invention is not delimited by the described embodiments but it may be varied within the scope of the appended patent claims.

Particularly, support bracket 18 needs not to be constructed from two separate side sections 20, 22 connected via a beam member 24. Instead the support brackets may be embodied as one piece profile or as a bended profile made from one or several pieces. It is also possible to use support brackets made from cast iron although this is not preferred for cost and weight reasons.

Furthermore, the cross beams 14 can also be mounted between the lower roller rails 32*a*, 32*b* to provide an additional stability on the support frame 10. Furthermore, the cross beams 14 do not need to extend exactly perpendicular to the longitudinal axis of the moving walk but they may also be configured in an inclined geometry, e.g. in a zigzag construction or grid between the roller rails 12*a,b*, 32*a,b* on both sides of the moving ramp.

Figure 6A:
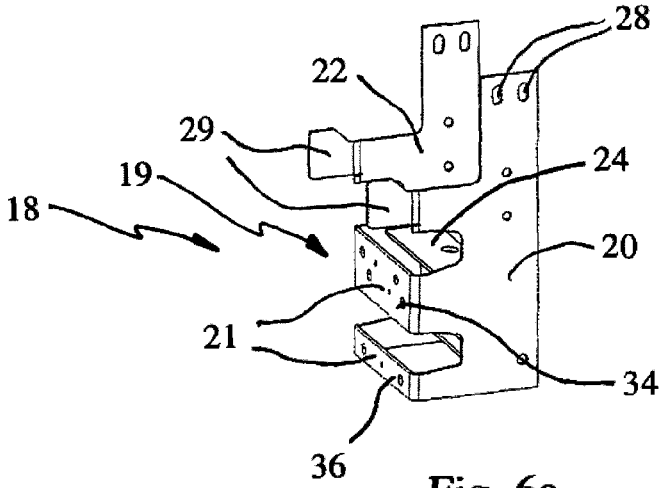
Figure 6B:
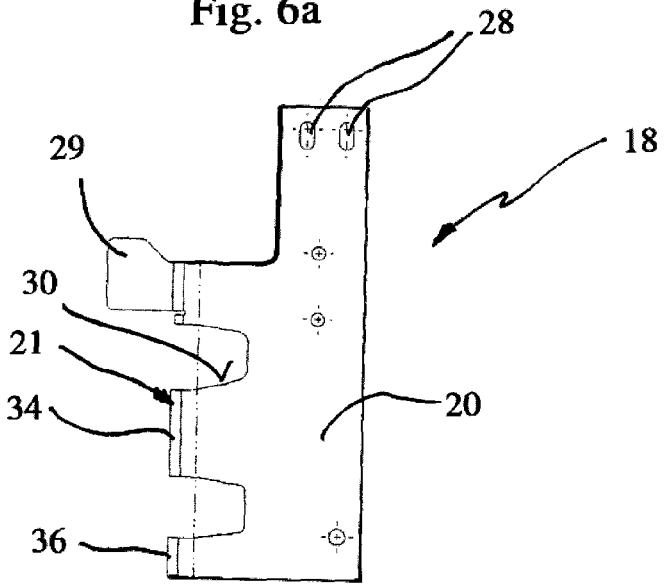
Figure 6C:
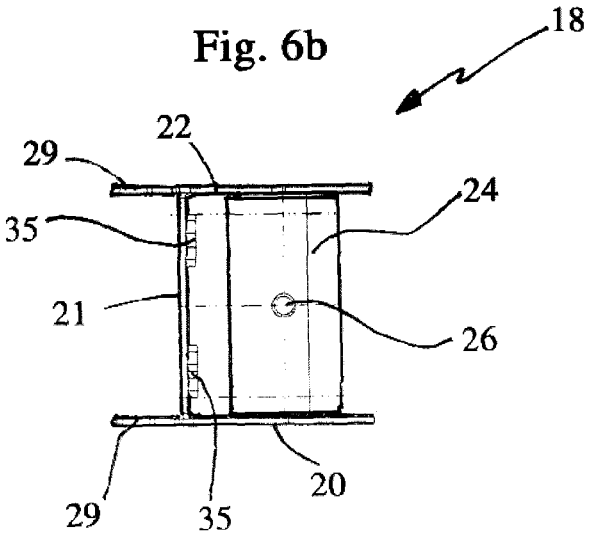

FIGS. 6*a* to 6*c* show the support bracket in detail, whereby FIG. 6*a* is a perspective view, FIG. 6*b* is a side view and FIG. 6*c* is a top view. The support bracket 18 comprises (or consists of) a U-profile 19 having a middle section 21 extending in longitudinal direction of the moving walk and on both sides thereof a side section 20, 22 extending perpendicularly to the longitudinal direction of the moving walk, respectively. The middle section 21 forms or carries the upper mounting area 34 for the upper roller rails 12*a,b* and the lower mounting area 36 for the lower roller rails 32*a,b*. The mounting areas 34, 36 may carry nuts 35 to which the roller rails 12*a,b*, 32*a,b* are fixed via bolts.

The side sections comprise fixings 28 for the balustrade fastening elements 38. In the embodiment the fixings are holes to which the balustrade fastening elements are connected via bolts or form-fitting protrusions.

Furthermore, the side sections 20, 22 of the U-profile 19*b* comprise flanges 29 to which the inner cover plates 48 are mounted.

The support bracket 18 of this embodiment can be manufactured very easily and inexpensive from two bent metal sheets, one for the U-profile 19 and the other for the beam member 24.

The invention claimed is:

1. A moving walk having an endless conveyor member comprising:

pallets; and at least one longitudinal drive member to which the pallets are connected, which drive member is engaged by a drive unit, the endless conveyor member runs in a middle section of the moving walk along an upper conveying track and along a lower return track; at both ends of the middle section the moving walk including a respective end section, whereby each end section comprises an entrance/exit area of the moving walk and a transfer means for transferring the endless conveyer member from the conveyor track to the return track and vice versa, which middle section includes, a self-supporting support structure, wherein the support structure is formed by roller rails, by cross beams and by support brackets, whereby the roller rails have an upper rail surface for rollers of the pallets, the cross beams connect the roller rails and/or the support brackets on both sides of the moving walk and the support brackets comprise the footing of the support structure and are spaced apart in the longitudinal direction of the roller rails and wherein the roller rails and/or the cross beams are mounted to the support brackets;

wherein the cross beams and the roller rails are mounted to the support brackets with one common mounting bolt.

2. The moving walk according to claim 1, wherein the roller rails are directly mounted to the support brackets and the cross beams are mounted to the roller rails.

3. The moving walk according to claim 2, wherein each support bracket consists of a vertical U-profile comprising one middle section with the mounting areas of the roller rails and two side sections, to which U-profile a beam member comprising an adjustable foot is connected.

4. The moving walk according to claim 2, wherein the roller rail is a rectangular steel profile, which comprises a steel bushing for a mounting bolt.

5. The moving walk according to claim 1, wherein each support bracket consists of a vertical U-profile comprising one middle section with the mounting areas of the roller rails and two side sections, to which U-profile a beam member comprising an adjustable foot is connected.

6. The moving walk according to claim 5, wherein the middle section comprises a mounting area for the mounting of the roller rail and/or the cross beam.

7. The moving walk according to claim 5, wherein the moving walk includes a balustrade fastening element and a handrail belt, and wherein the two side sections comprise fixings for the balustrade fastening element and the recess for the handrail belt.

8. The moving walk according to claim 1, wherein the roller rail is a rectangular steel profile, which comprises a steel bushing for a mounting bolt.

9. The moving walk according to claim 8, wherein the cross beams are mounted to the roller rails via perpendicular end plates.

10. The moving walk according to claim 1, wherein the support brackets have fixings for a balustrade fastening element.

11. The moving walk according to claim 10, wherein the recess is located below the fixings for the balustrade fastening element.

12. The moving walk according to claim 1, wherein the support brackets have a recess for a handrail belt of the moving walk.

13. The moving walk according to claim 1, wherein the support brackets comprise fastening points for inner cover plates and outer cover plates.

14. The moving walk according to claim 1, wherein the balustrade fastening element is a holding clamp which form fits on the support bracket.

15. A moving walk having an endless conveyor member comprising:

pallets: and at least one longitudinal drive member to which the pallets are connected, which drive member is enraged by a drive unit, the endless conveyor member runs in a middle section of the moving walk along an upper conveying track and along a lower return track; at both ends of the middle section the moving walk including a respective end section, whereby each end section comprises an entrance/exit area of the moving walk and a transfer means for transferring the endless conveyer member from the conveyor track to the return track and vice versa, which middle section includes, a self-supporting support structure, wherein the support structure is formed by roller rails, by cross beams and by support brackets, whereby the roller rails include upper roller rails for the conveyor track, and separate lower roller rails for the return track, whereby the support brackets have two vertically spaced apart mounting areas with the upper and lower roller rails respectively mounted thereto, the cross beams connecting the roller rails and/or the support brackets on both sides of the moving walk and the support brackets forming the footing of the support structure and being spaced apart in the longitudinal direction of the roller rails and wherein the roller rails and/or the cross beams are mounted to the support brackets.

16. The moving walk according to claim 15, wherein the cross beams are mounted between the upper roller rails or between the upper roller rails and the lower roller rails, respectively.

* * * * *